US006620038B1

(12) United States Patent
Kikuchi et al.

(10) Patent No.: US 6,620,038 B1
(45) Date of Patent: Sep. 16, 2003

(54) SUCTION AND EXHAUST DEVICE

(75) Inventors: Yoshimasa Kikuchi, Sakai (JP); Yoshinori Narikawa, Sakai (JP)

(73) Assignee: Daikin Industries, Ltd., Osaka (JP)

( * ) Notice: Subject to any disclaimer, the term of this patent is extended or adjusted under 35 U.S.C. 154(b) by 0 days.

(21) Appl. No.: 10/111,615

(22) PCT Filed: Oct. 23, 2000

(86) PCT No.: PCT/JP00/07371

§ 371 (c)(1),
(2), (4) Date: Apr. 26, 2002

(87) PCT Pub. No.: WO01/31263

PCT Pub. Date: May 3, 2001

(30) Foreign Application Priority Data

Oct. 26, 1999 (JP) ..... 11-303705

(51) Int. Cl.[7] ..... F24F 9/00
(52) U.S. Cl. ..... 454/66; 126/299 D; 454/189
(58) Field of Search ..... 454/66, 189, 191, 454/244, 248; 129/299 R, 299 D

(56) References Cited

U.S. PATENT DOCUMENTS

| | | | | |
|---|---|---|---|---|
| 1,487,828 A | * | 3/1924 | Ziganek et al. | 454/244 |
| 3,393,626 A | * | 7/1968 | Braun et al. | 454/66 |
| 5,263,897 A | * | 11/1993 | Kondo et al. | 454/189 |

FOREIGN PATENT DOCUMENTS

| | | | | |
|---|---|---|---|---|
| DE | 85 34 590 | | 1/1987 | |
| EP | 0 307 284 | | 3/1989 | |
| JP | 49-20946 A | | 2/1974 | |
| JP | 53-70539 A | | 6/1978 | |
| JP | 56-133547 A | | 10/1981 | |
| JP | 10-160174 a | | 6/1993 | |
| JP | 6-182131 | | 7/1994 | |
| JP | 9-26178 | | 1/1997 | |
| JP | 10-267374 | | 10/1998 | |
| JP | 10-288371 A | | 10/1998 | |
| JP | 11-63610 A | | 3/1999 | |
| SU | 601530 | * | 4/1978 | 454/189 |

* cited by examiner

*Primary Examiner*—Harold Joyce
(74) *Attorney, Agent, or Firm*—Birch, Stewart, Kolasch & Birch, LLP.

(57) ABSTRACT

A suction and exhaust device wherein air is supplied as air curtain flow through air outlet (3) while the air surrounded by the air curtain flow is sucked through suction ports (2*b*) to be exhausted. A supply space in the device is divided into two chambers, upper and lower, by a partition plate (41): a first supply air space (4*c*) on the upper side into which air from the supply air duct (5) is introduced and a second supply air space (4*d*) which spreads in the direction of the air outlet (3). The first and second supply air spaces (4*c*, 4*d*) are communicated with each other through annular flow equalizing channel (40R, 50R) of small channel diameter vertically extending in the outer periphery of the suction duct (3). This uniformalizes the flow rate distribution of the supply air flow from the air outlet and forms a stabilized air curtain flow.

6 Claims, 13 Drawing Sheets

SUCTION AND EXHAUST DEVICE

This application is the national phase under 35 U.S.C. §371 of PCT International Application No. PCT/JP00/07371 which has an International filing date of Oct. 23, 2000 which designated the United States of America.

TECHNICAL FIELD

The present invention relates to an air supply and exhaust apparatus that forms air curtain flow surrounding outer circumference of a specified local region and that exhausts air in the local region inside the air curtain flow by sucking the air in a direction opposite to the air curtain flow.

BACKGROUND ART

As ventilating apparatus for ventilating a specified local region, for example, the inventor and others have already proposed apparatus that supply airflow like air curtain surrounding the local region while suck and exhaust air in the local region inside the air curtain flow.

FIG. 13 shows an example of the apparatus.

In FIG. 13, reference numeral 4 denotes a fresh-air supply chamber that is, for example, generally conical in shape and that is provided over the local region. Immediately beneath the fresh-air supply chamber 4, a suction hood 10 shaped like a dome having a comparatively shallow depth and spreading along a direction of exhaust is detachably provided a specified distance apart from the chamber so as to have an opening edge 10*d* projecting downward from a bottom opening surface of the fresh-air supply chamber 4 by a specified size. Between the fresh-air supply chamber 4 and the suction hood 10 inside the chamber, as a result, a supply air swirling space having passage diameters increasing gradually along a traveling direction is formed for guiding toward an air outlet 3 fresh air introduced through a fresh-air introducing port 5*a* of a fresh-air supply duct (supply air duct) 5 that will be mentioned later while swirling the fresh air effectively. In the supply air swirling space, airflow to be supplied to the air outlet 3 is previously formed into swirl flow having specified flow velocities.

Above the suction hood 10 in the supply air swirling space is provided a straightening plate 6 having a large number of airflow straightening holes 6*a*, 6*a*, . . . for straightening swirl flow formed as described above and for equalizing distribution of flow velocity of the swirl flow. The straightening plate 6 is formed of, for example, a punching plate, and outside and inside edges of the plate are fixed to the fresh-air supply chamber 4 and to a sleeve (coupling member) 20 surrounding a suction duct 2 that will be described later, by the medium of ring-like corner brackets 61 and 62, respectively.

The curved fresh-air introducing port 5*a* at an end of the fresh-air supply duct 5 is connected to and communicates with the fresh-air supply chamber 4 so as to introduce fresh air supplied from the outdoors in oblique tangential directions (swirling directions). The suction duct 2 is connected to and communicates with the suction hood 10, and the suction duct 2 is introduced downward through a top plate (apex) 4*a* of the fresh-air supply chamber 4 and extends (projects) cylindrically so that a suction port 2*a* at a lower end of the duct 2 is positioned in the vicinity of a surface of an air-collecting opening 10*a* of the suction hood 10. A fresh-air inlet end of the fresh-air supply duct 5 and an inside-air exhaust end of the suction duct 2 extend outdoors. At the ends extending outdoors (not shown) of the fresh-air supply duct 5 and the suction duct 2 are provided a fresh-air supply fan (air supply fan) and a suction fan (exhaust suction fan), respectively, that are composed of, for example, multi-blade fans (sirocco fans). Those fans are driven so as to perform corresponding functions of supplying fresh air and sucking exhaust.

The sleeve 20 that can be penetrated by the suction duct 2 is fitted on the outer circumference of the suction duct 2 in the supply air swirling space. Besides the straightening plate 6, swirl flow generating stators 30*a*, 30*a*, . . . and the suction hood 10 are integrated with the fresh-air supply chamber 4 through the medium of the sleeve 20, as will be described later.

The suction duct 2 is inserted into the sleeve 20, the position of the suction port 2*a* is then set suitably as described above, and the duct is thereafter fixed.

On the circumference of the suction duct 2 and above the suction port 2*a* are provided auxiliary suction ports 2*b*, 2*b*, . . . for sucking inside air collected in the suction hood 10. At a lower end of the suction port 2*a* is provided an oil sump 7 having an oil sump groove 7*a* and having a cross section shaped like a letter U.

The air outlet 3 has a passage with a specified length, for example, between an inner circumferential surface of the fresh-air supply chamber 4 on the side of a lower end 4*b* and an outer circumferential surface of a shoulder 10*c* of the suction hood 10, has an all-around continuous annular opening, and is slantingly formed with a specified tilt angle so that center diameters of the outlet gradually expand toward the lower end of the outlet. In the air outlet passage are arranged a large number of swirl flow generating stators 30*a*, 30*a*, . . . that extend spirally downward with a specified tilt angle (radial angle) and that are spaced at specified intervals circumferentially.

The swirl flow generating stators 30*a*, 30*a*, . . . are formed as follows, in shape of gentle circular arcs each having specified length and width and extending parabolically with a specified radial angle. An outer circumferential edge of a flat circular metal plate 30 having a center aperture to be fitted on the sleeve 20 is slit parabolically and cut into strips in accordance with a number of the swirl flow generating stators 30*a*, 30*a*, . . . to be provided, and the cut strips are bent to a specified angle at specified positions (positions on radial lines) on the side of a main body 30*b* of the flat metal plate 30. The sleeve fitting aperture, that is, an inner circumference of the main body 30*b* of the flat metal plate is fitted and mounted from above on a lower end flange 20*a* of the sleeve 20 on the outer circumference of the suction duct 2, is positioned with use of round slots, and is fixed by screws, so that the swirl flow generating stators 30*a*, 30*a*, . . . are properly installed in the air outlet passage of the air outlet 3.

On underside of the lower end flange 20*a* of the sleeve 20 that supports the flat plate main body 30*b* of the swirl flow generating stators 30*a*, 30*a*, . . . in such a manner, a top plate section 10*b* of the dome-shaped suction hood 10 is integrally mounted by detachable mounting means such as slide engagement method so that attachment or detachment of the hood can easily be performed with an operation from below.

That is, attachment of the suction hood 10 is achieved, for example, as follows. On underside of the lower end flange 20*a* of the sleeve 20, hooked engaging pieces 13, 13, . . . each having a specified vertical gap are provided. On the side of the top plate 10*b* of the suction hood 10, on the other hand, rectangular engaging holes are provided. The engaging pieces 13, 13, . . . are arbitrarily fitted into the engaging holes, the hood is then slid and turned by a specified turning angle from the fitting position in a circumferential direction, and side edges of the holes thereby come into the gaps so as to achieve overlap engagement with completion of positioning of the hood. The hood is fixed by screws in the engagement position.

When the fresh-air supply fan on the side of the fresh-air supply duct 5 and the suction fan on the side of the suction duct 2 in the above configuration are driven, for example, fresh air guided into the fresh-air introducing port 5*a* through the fresh-air supply duct 5 is initially blown out into the supply air swirling space in tangential directions by a blast pressure from the fresh-air supply fan. The air is straightened by the straightening holes 6*a*, 6*a*, . . . of the straightening plate 6 while being swirled efficiently in the supply air swirling space, and resultant stable swirl flow with equalized flow velocities is supplied to the air outlet 3 provided between the inner circumferential surface of the fresh-air supply chamber 4 on the side of the lower end 4*b* and the outer circumferential surface of the shoulder 10*c* of the suction hood 10. When the swirl flow passes through the air outlet passage of the air outlet 3, the swirl flow generating stators 30*a*, 30*a*, . . . impart still larger vector in the swirling direction to the flow, which turns into stronger and stable spiral swirl airflow F1 with equalized air velocities in all circumferential directions and is blown out downward in oblique directions toward the outer circumference of the specified local region.

As a result, the blowoff swirl airflow F1 that is spiral and stable forms air curtain flow that reliably encircles air in the specified local region so as to prevent the air from diffusing into the surroundings. Inside the airflow F1 and along a central axis thereof, on the other hand, stable swirl suction airflow F2 is formed that vertically ascends like a tornado by the action of a suction force the suction fan exerts, in a direction opposite to the airflow F1, i.e., toward the suction port 2*a* extending tubularly up to the vicinity of the surface of the opening 10*a* of the suction hood 10 of the suction duct 2.

This arrangement makes possible reliable exhaust of air in the local region encircled by the air curtain flow composed of the spiral blowoff swirl airflow F1.

The air supply and exhaust apparatus with the above configuration, however, has some problems in such respects as the following.

In the configuration of the air supply and exhaust apparatus in FIG. 13, fresh air is introduced into the large supply air swirling space in the fresh-air supply chamber 4 through one supply duct 5, and it is therefore difficult to diffuse dynamic pressure of the introduced airflow and there is a limit to achieving uniform straightening effect all over the whole straightening surface of the straightening plate 6. That is, a portion of the airflow having a high dynamic pressure passes fast through the straightening plate 6, and a portion of the airflow having a low dynamic pressure passes slowly through the plate 6. Accordingly, swirl flow with equalized distribution of flow velocity cannot be generated, and blowoff airflow is therefore disturbed so that it is difficult to form reliable air curtain flow.

This problem becomes further remarkable in conventional air supply and exhaust apparatus that blow off air from the air outlet 3 without swirling the air by means of the swirl flow generating stators 30*a*, 30*a*, . . . and thereby form air curtain flow in contrast to the above apparatus.

DISCLOSURE OF INVENTION

The invention has been made in order to solve such a problem. An object of the invention is to provide an air supply and exhaust apparatus that is capable of diffusing effectively a dynamic pressure of air fed into a supply air space so as to equalize distribution of flow velocity of blowoff airflow from an air outlet and so as to be capable of forming more stable air curtain flow.

In order to attain the object, the invention is configured with the following means for problem solution.

The invention provide an air supply and exhaust apparatus for blowing out air that has a specified blast pressure and that is introduced into an upper region in a specified supply air space from a supply air duct, as air curtain flow, to an outer circumference of a specified local region through a lower air outlet that has a circumferential opening, while sucking air in the specified local region encircled by the air curtain flow, in a direction opposite to a direction in which the air is blown out, through a suction port located inside the air outlet into an upper region of a suction duct that is bored through a center part of the supply air space to extend outdoors, and exhausting the sucked air, characterized in that: the supply air space is divided by a partition plate into two upper and lower chambers, i.e., an upper first supply air space introducing air from the supply air duct and a second supply air space extending toward the air outlet; and the first and second supply air spaces are communicated with each other through annular straightening passages of small passage diameters extending vertically on an outer circumference of the suction duct.

In this manner, the supply air space into which air is supplied from the supply air duct is divided by the partition plate into two upper and lower chambers, i.e., the upper first supply air space into which air from the supply air duct is introduced and the lower second supply air space which extends toward the air outlet having the circumferential opening, and the first and second supply air spaces are communicated with each other through the annular straightening passages of the small passage diameters which extend vertically on the outer circumference of the suction duct extending through center parts of the supply air spaces. With this arrangement, air that flows into the first supply air space from the supply air duct with a dynamic pressure on a given level is temporarily interrupted by the partition plate and is uniformly dispersed in all over the first supply air space.

After that, the air flows evenly from all around directions into the annular straightening passages having stable shapes, the decreased passage diameters, and specified vertical lengths, and is throttled when flowing through the annular straightening passages in a specified period of time, so that flow velocities of the air are further equalized.

The airflow having the flow velocities further equalized is then forwarded radially outward evenly in the second supply air space that extends toward the air outlet as described above, and is blown out downward from the air outlet provided circumferentially, evenly in all around directions toward an outer circumference of the specified local region, so as to form air curtain flow that effectively encircles the local region.

With the configuration, as a result, air curtain flow having flow velocity distribution further equalized is formed without influence of deviated-flow pattern in the supply air space in which air is introduced, in contrast to the straightening plate described above.

In one embodiment of the air supply and exhaust apparatus, the straightening passage is defined by a cylinder wall provided a specified distance apart from the suction duct.

With the configuration, consequently, annular straightening passage having a double-cylinder structure is suitably shaped by the suction duct extending through the center parts of the first and second supply air spaces and by the cylinder wall surrounding the suction duct.

In one embodiment of the air supply and exhaust apparatus, the straightening passages are defined by a first cylinder wall provided a specified distance apart from the suction duct and having openings at both upper and lower ends thereof and by a second cylinder wall provided a specified distance apart from the first cylinder wall and having an opening only at a lower end thereof.

With the configuration, consequently, annular straightening passage having a nested-cylinder structure and having still greater straightening effect is suitably shaped by the suction duct extending through the center parts of the first and second supply air spaces, by the first cylinder wall provided around the suction duct, and by the second cylinder wall provided around the first cylinder wall. In this configuration, air supplied into the first supply air space from the supply air duct is initially interrupted by the partition plate, is uniformly dispersed in all over the first supply air space, thereafter flows upward, and thereafter flows downward while being throttled.

In one embodiment of the air supply and exhaust apparatus, straightening plates having a large number of straightening holes are provided in the straightening passage.

Where the straightening plates having the large number of straightening holes are provided in the straightening passage that achieves an efficacious straightening effect based on such a throttling effect as described above, flow velocities of supply air that includes deviated flow when flowing into the straightening passage are further effectively straightened when the air passes through the large number of straightening holes, and distribution of the flow velocities are thereby equalized further.

In one embodiment of the air supply and exhaust apparatus, swirl flow generating stators for swirling spirally air that is blown out are provided in the air outlet.

When supply air having flow velocity distribution equalized by the effect of the straightening passages as described above passes through the air outlet 3 with the configuration, the swirl flow generating stators impart vector in swirling direction to the supply air, which turns into stable spiral swirl airflow F1 having air velocities equalized in all circumferential directions and is blown out downward to the outer circumference of the specified local region.

As a result, the blowoff swirl airflow F1 that is spiral and stable forms further reliable air curtain flow that encircles air in the specified local region so as to prevent diffusion thereof into surroundings.

In one embodiment of the air supply and exhaust apparatus, the supply air duct supplies air in swirling directions into the first supply air space.

With the configuration, air flows into the first supply air space in tangential directions from the supply air duct, and therefore air to be supplied to the air outlet through the straightening passages is previously formed into swirl flow, so that air curtain flow which is ultimately formed is further stabilized. Where the swirl flow generating stators are provided in the air outlet, in particular, the configuration further improves a function of generating swirl flow that is achieved by the swirl flow generating stators.

As a result, satisfactory air curtain flow that is closed more tightly is formed.

In accordance with the air supply and exhaust apparatus of the invention, as described above, flow velocity distribution of the blowoff airflow can be equalized and therefore exhaust from the specified local region can be achieved efficiently.

In the case that the air supply and exhaust apparatus is applied, for example, to a local ventilator, accordingly, ventilation of the specified local region can be achieved efficiently enough with reliable air curtain flow having stable flow velocity distribution.

BEST MODE FOR CARRYING OUT THE INVENTION

Embodiment 1

Figure 1:
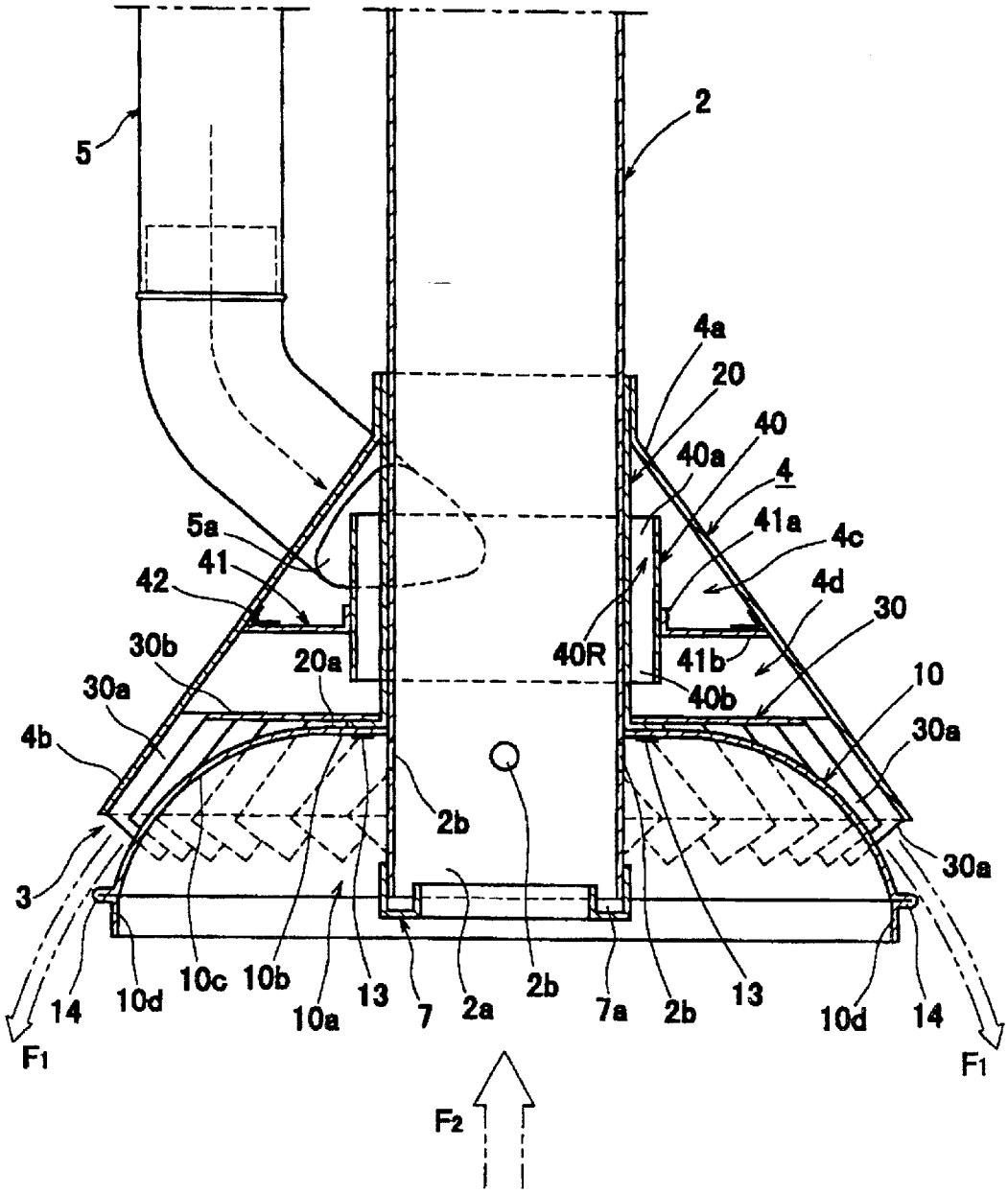
FIG. 1 is a sectional view showing a configuration of a tornado-type local ventilator composed with employment of an air supply and exhaust apparatus in accordance with an embodiment 1 of the invention.
Figure 2:
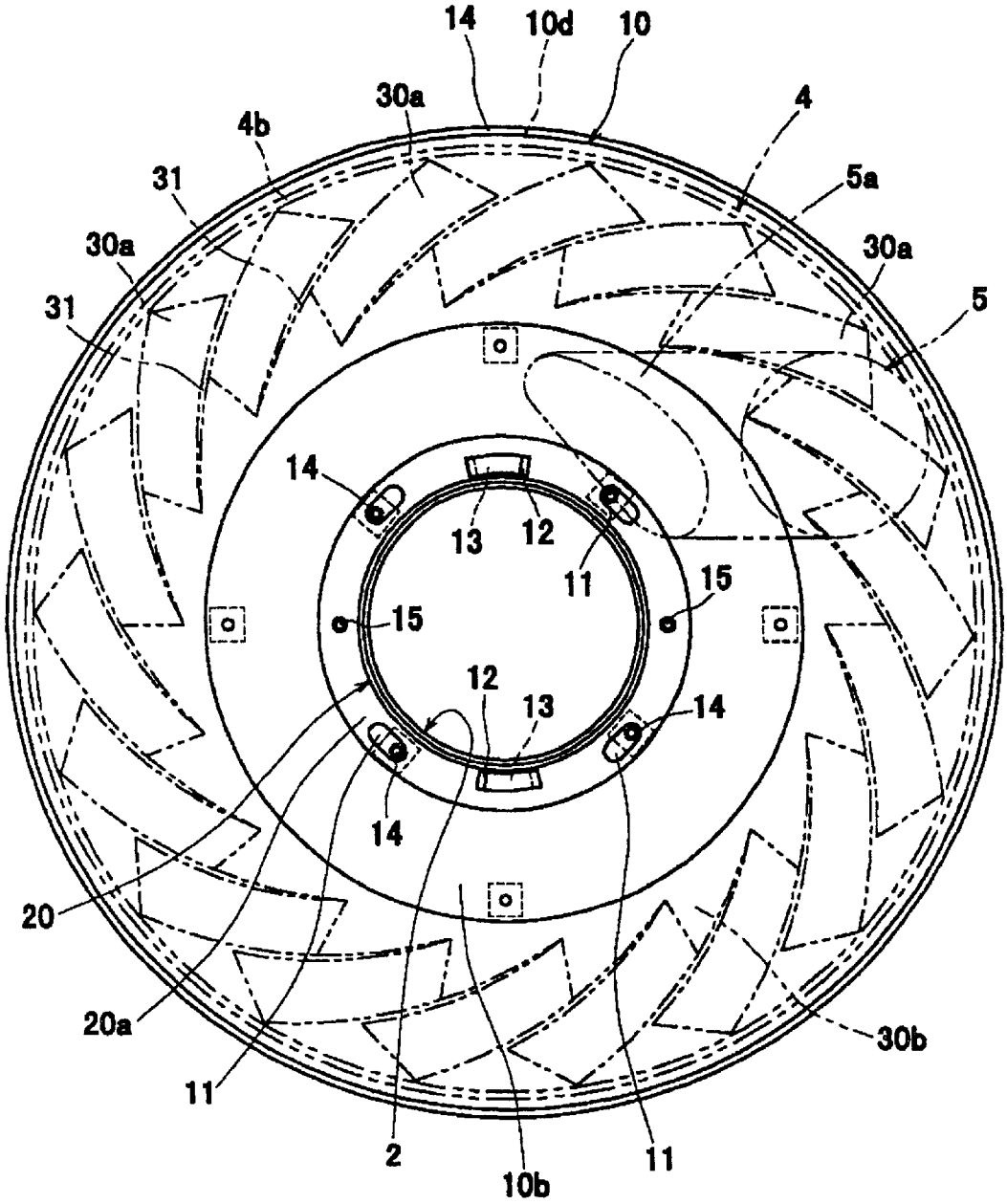
FIG. 2 is a plan view showing a configuration of an important part of the air supply and exhaust apparatus.
Figure 3:
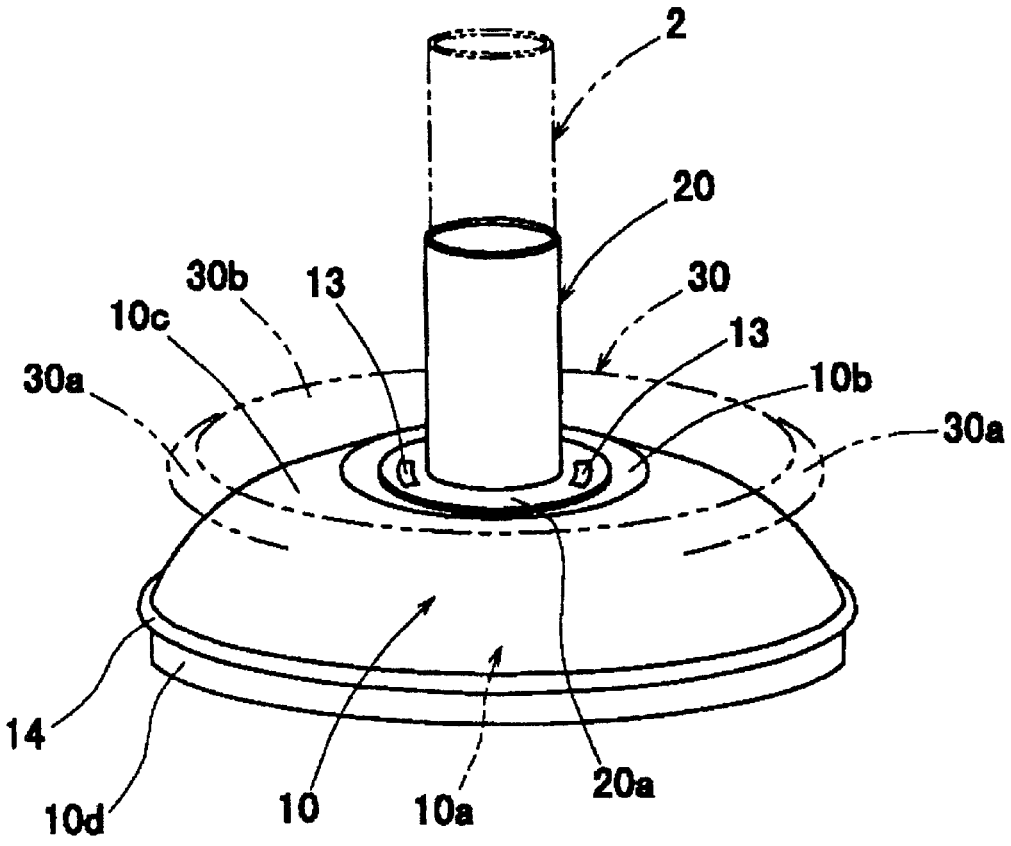
FIG. 3 is a perspective view showing a configuration of an important part of the air supply and exhaust apparatus.

FIGS. 1 to 8 show a configuration of a tornado-type local ventilator composed with employment of an air supply and exhaust apparatus in accordance with an embodiment 1 of the invention.

This tornado-type local ventilator is provided, for example, above heating and cooking equipment as a specified local region, such as a gas range table in a kitchen of an ordinary house and a kitchen for business of a restaurant. The ventilator encircles the heating and cooking equipment with downward spiral swirl vortex flow F1 that is like air curtain and is composed of fresh air introduced from the outdoors. On the other hand, the ventilator forms tornado-like upward suction air swirl vortex flow F2 inside the air-curtain-like spiral swirl vortex flow F1 by an action of a suction negative pressure that acts on a center region inside the vortex flow F1 in a direction in which air is to be sucked.

By the ascending tornado-like swirl vortex flow F2, smoke, smell, and the like generated by the heating and cooking equipment in the specified local region can be sucked efficiently and can be exhausted to the outdoors.

In FIGS. 1 to 8, reference numeral 4 denotes a fresh-air supply chamber (supply air chamber) that is, for example, generally conical and is provided above a source of contaminated air such as smell, smoke, and the like in the specified local region. Immediately beneath the fresh-air supply chamber 4, a suction hood 10 shaped like a dome having a comparatively shallow depth and spreading along the direction of exhaust is detachably provided a specified distance apart from the chamber in offset state such that a lower end 10*d* of an opening edge of an air-collecting opening 10*a* of the hood projects downward by a specified size from an opening surface on the side of a lower end 4*b* of the fresh-air supply chamber 4 (as will be described later). Between the fresh-air supply chamber 4 and the suction hood 10 inside the chamber, as a result, a supply air space having passage diameters increasing gradually along a traveling direction is formed for guiding toward an air outlet 3 (that will be described later) fresh air introduced through a fresh-air introducing port 5*a* of a fresh-air supply duct (supply air duct) 5 that will be described later while swirling the fresh air effectively, so that airflow to be supplied to the air outlet 3 is previously formed into swirl flow having specified flow velocities.

With a vertical offset of a specified size between the opening surface of the fresh-air supply chamber 4 and an opening surface of the suction hood 10 as described above, the air outlet 3 that will be described later uses a space formed between an inner circumferential surface of the lower end 4*b* of the fresh-air supply chamber 4 and an outer circumferential surface of a shoulder 10*c* of the suction hood 10, is on lateral side of a main body of the apparatus, has a passage with a specified length along the blowoff direction, has an all-around continuous annular opening, and is slantingly formed with a specified tilt angle so that diameters of a center region of the passage gradually expand toward the lower end thereof.

In the supply air space in the fresh-air supply chamber 4, airflow control means having a flow velocity control structure for equalizing distribution of flow velocity of airflow in the swirling direction that is introduced as described above is provided above the suction hood 10. As shown in the drawings, the airflow control means is formed of a partition plate 41 that partitions the supply air space into an upper first supply air swirling space 4*c* to which fresh air is supplied from the fresh-air supply duct 5 and into a lower second supply air swirling space 4*d* which extends radially outward on the side of the air outlet 3 (which will be described later), and of a cylinder wall 40 that is vertically inserted through and fitted into a center region of the partition plate 41 and that has a diameter larger by specified size than diameters of a suction duct 2 and a sleeve 20 which will be described later. The partition plate 41 is to a bottom of the supply air space, and an outer circumferential edge 41*b* of the plate is mounted on an inner circumferential wall surface of the fresh-air supply chamber 4 through a medium of a ring-like corner bracket 42.

In the center region of the plate 41, a circular opening edge 41*a* having a sleeve structure for fitting integration of the cylinder wall 40 is formed by a method such as punching. The cylinder wall 40 is fitted into an opening inside the opening edge 41*a* so that a projecting upper part of the wall is longer than a projecting lower part of the wall, and the wall is fixed and integrated by means such as screws (or brazing). The cylinder wall 40 surrounds the sleeve 20 on the outer circumference of the suction duct 2 that will be described below and has an inside diameter that is sufficient to keep a specified space between the sleeve 20 and the wall. An upper end opening 40*a* of the wall is supported so that a specified space is kept between a top plate 4*a* of the fresh-air supply chamber 4 and the opening 40*a*, and a lower end opening 40*b* of the wall is supported so that a specified space is kept between a main body 30*b* of a flat metal plate 30 that will be described later and the opening 40*b*. With this arrangement, there is formed an annular straightening passage 40R that allows the upper first supply air swirling space 4*c* and the lower second supply air swirling space 4*d* to communicate with each other and allows swirl flow in the first supply air swirling space 4*c* to flow into the second supply air swirling space 4*d* after equalizing flow velocity distribution of the flow by a decreased diameter of the passage of the flow.

The curved fresh-air introducing port 5*a* at an end of the fresh-air supply duct 5 is connected to and communicates with the first supply air swirling space 4*c* in the fresh-air supply chamber 4 so as to introduce fresh air supplied from the outdoors in oblique tangential directions (swirling directions). The suction duct 2 is connected to and communicates with the suction hood 10. The suction duct 2 is introduced vertically through the top plate (apex) 4*a* of the fresh-air supply chamber 4, the first and second supply air swirling spaces 4*c*, 4*d*, and the suction hood 10, and extends (projects) cylindrically so that a suction port 2*a* at a lower end of the duct 2 is positioned in the vicinity of a surface of an air-collecting opening 10*a* of the suction hood 10. A fresh-air inlet end of the fresh-air supply duct 5 and an inside-air exhaust end of the suction duct 2 extend outdoors. At the ends extending outdoors (not shown) of the fresh-air supply duct 5 and the suction duct 2 are provided a fresh-air supply fan and a suction fan (exhaust suction fan), respectively, that are composed of multiblade fans (sirocco fans), for example, and that are driven so as to perform corresponding functions of supplying fresh air and sucking exhaust.

The sleeve 20 that can be penetrated by the suction duct 2 is fitted on an outer circumference of the suction duct 2 in the first and second supply air swirling spaces 4*c* and 4*d*. A main body part 30*b* of swirl flow generating stators 30*a*, 30*a*, . . . that will be described later and the suction hood 10 are integrated with the fresh-air supply chamber 4 through medium of the sleeve 20, as will be described later.

The suction duct 2 is inserted into the sleeve 20, the position of the suction port 2*a* is then set suitably as described above, and the duct is thereafter fixed.

On the outer circumference of the suction duct 2 and above the suction port 2*a* are provided auxiliary suction ports 2*b*, 2*b*, . . . for sucking inside air collected in the suction hood 10. At a lower end of the suction port 2*a* is provided an oil sump 7 having an oil sump groove 7*a* with a cross section shaped like a letter U.

As described above, the air outlet 3 has the passage with the specified length, for example, between the inner circumferential surface of the fresh-air supply chamber 4 on the side of the lower end 4*b* and the outer circumferential surface of the shoulder 10*c* of the suction hood 10, has the all-around continuous annular opening, and is slantingly formed with the specified tilt angle so that the center diameters of the outlet gradually expand toward the lower end of the outlet. In the air outlet passage are arranged a large number of swirl flow generating stators 30*a*, 30*a*, . . .

extending spirally and downward with the specified tilt angle (radial angle) and spaced at specified intervals circumferentially.

Figure 4:
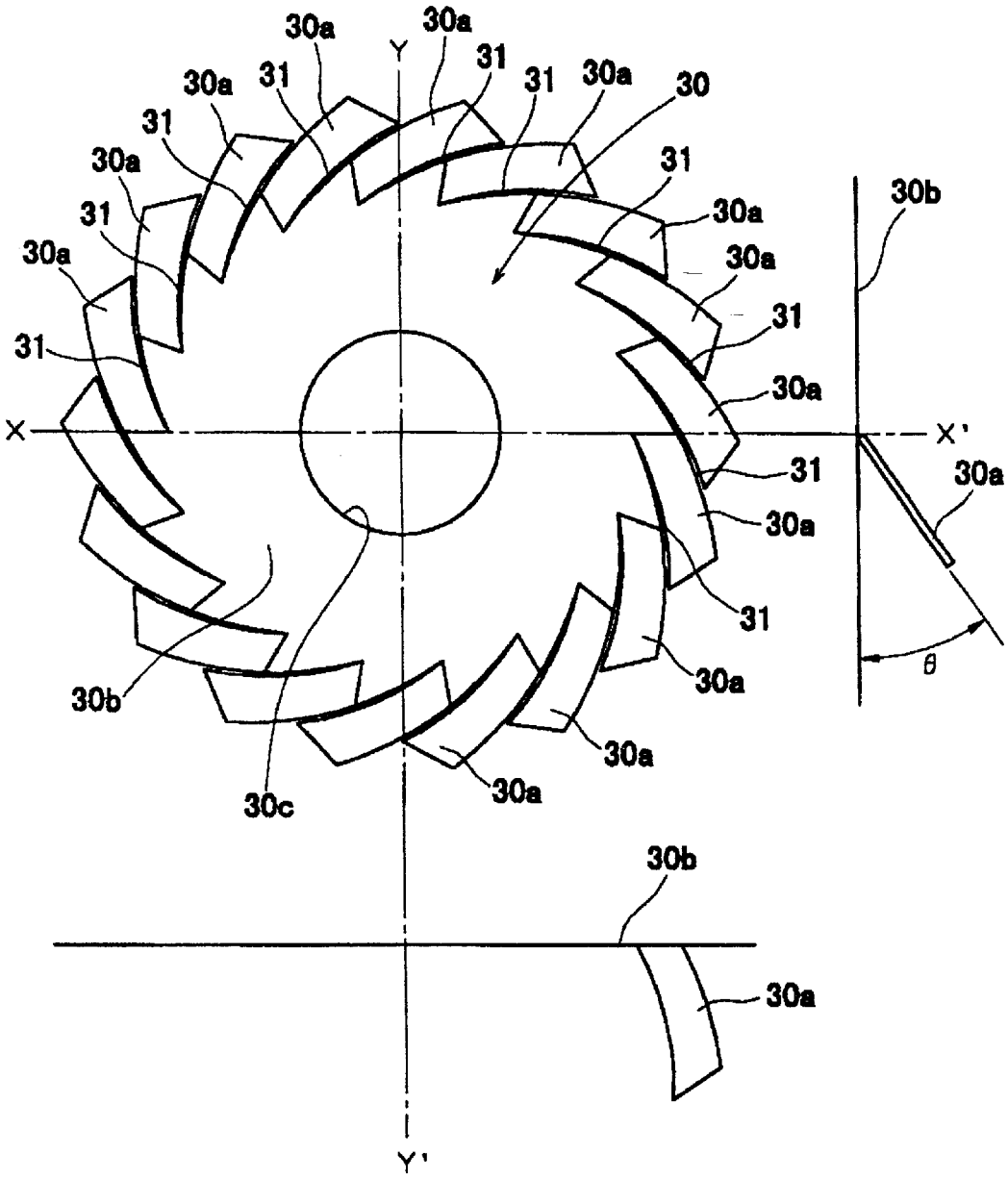
FIG. 4 is an explanatory plan view showing a configuration of an important part of the air supply and exhaust apparatus.
Figure 5:
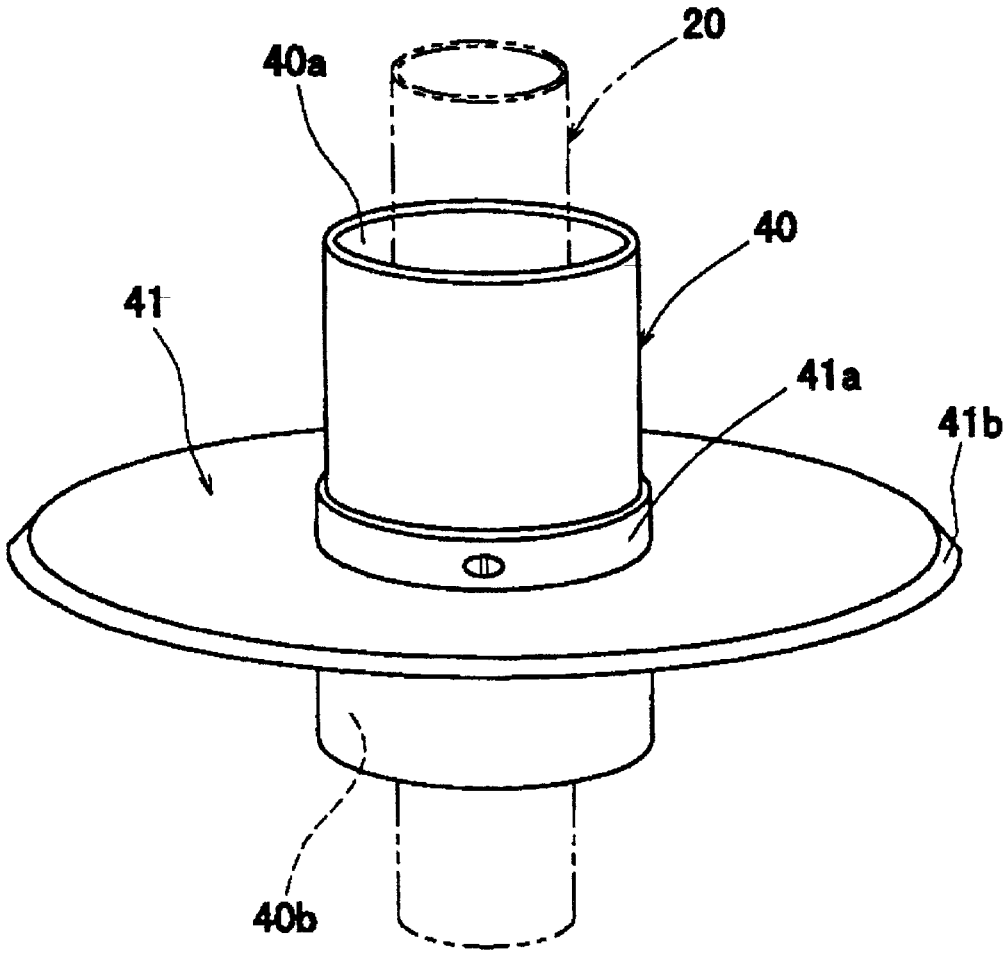
FIG. 5 is a perspective view showing a configuration of an important part of the air supply and exhaust apparatus.

As shown in FIG. 4, for example, the swirl flow generating stators 30*a*, 30*a*, . . . are formed as follows, in a shape of gentle circular arcs having specified length and width and extending in parabolic directions with a specified radial angle. An outer circumferential edge of a flat circular metal plate 10 having a center aperture 30*c* to be fitted on the sleeve 20 is provided with slits 31, 31, . . . extending in the parabolic directions and is cut into strips in accordance with the number of the swirl flow generating stators 30*a*, 30*a*, . . . to be provided. The cut strips are bent to a specified angle θ at specified positions (positions on radial lines) on the side of the main body 30*b* of the flat metal plate 30. The sleeve fitting aperture 30*c*, that is, an inner circumference of the main body 30*b* of the flat metal plate is fitted and mounted from above on a lower end flange 20*a* of the sleeve 20 on the outer circumference of the suction duct 2, is positioned with use of round slots 11, 11, . . . , and is thereafter fixed by screws 14, 14, . . . , so that the swirl flow generating stators 30*a*, 30*a*, . . . are properly installed in the air outlet passage of the air outlet 3.

On underside of the lower end flange 20*a* of the sleeve 20 that supports the flat metal plate main body 30*b* of the swirl flow generating stators 30*a*, 30*a*, . . . in such a manner, a top plate section 10*b* of the dome-shaped suction hood 10 is integrally mounted by detachable mounting means such as slide engagement method so that attachment or detachment of the hood can easily be performed with an operation from below.

That is, attachment of the suction hood 10 is achieved, for example, as follows. On underside of the lower end flange 20*a* of the sleeve 20, hooked engaging pieces 13, 13, . . . each having a specified vertical gap are provided. On the side of the top plate 10*b* of the suction hood 10, on the other hand, rectangular engaging holes 12, 12, . . . are provided. The engaging pieces 13, 13, . . . are arbitrarily fitted into the engaging holes 12, 12, . . . , the hood is slid and turned by a specified turning angle from the fitting position in a circumferential direction, and side edges of the holes thereby come into the gaps so as to achieve overlap engagement with completion of positioning of the hood. The hood is fixed by screws 15, 15, . . . in the engagement position.

In the embodiment, an airflow control edge 14 is provided on an outer circumferential surface of the opening edge of the suction hood 10.

In accordance with this configuration, blowoff airflow that blows from the air outlet 3 attaches to the airflow control edge 14 and therefore blowoff directions of the airflow can be fixed without decrease in wind velocity of the blowoff airflow, so that stable swirl flow can be generated.

Figure 8:
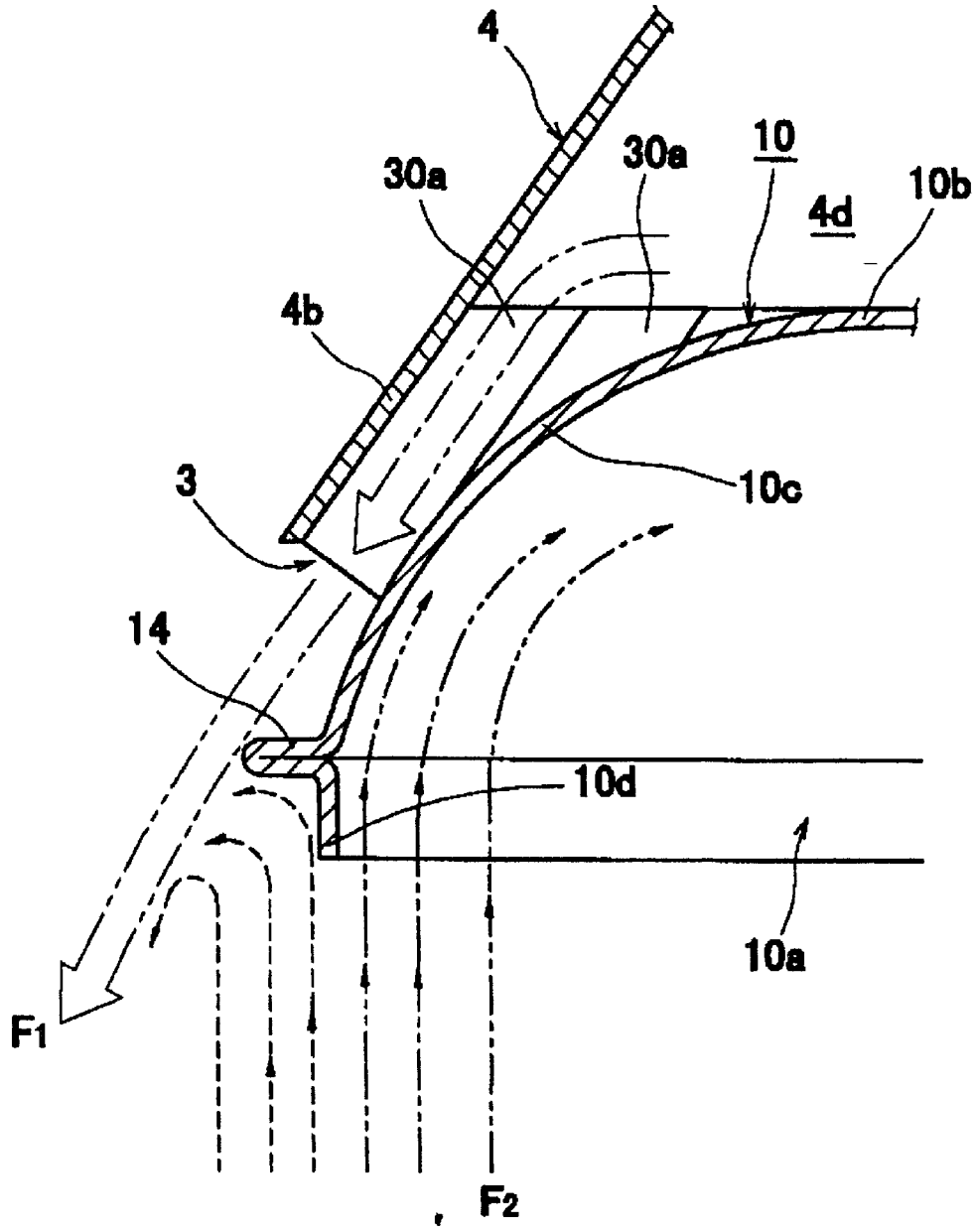
FIG. 8 is an enlarged sectional view showing function of an important part of the air supply and exhaust apparatus.

In this case, the air-collecting opening 10*a* of the suction hood 10 is configured so as to have the lower end 10*d* of the opening edge extending downward from the airflow control edge 14 by a specified size, as shown in FIG. 8.

Where the airflow control edge 14 provided on the outer circumference of the suction hood 10 extends radially outward from the opening surface of the air-collecting opening 10*a* of the suction hood 10 as described above, radially outward velocity component of an outer circumferential portion of the ascending swirl airflow F2 to be collected into the suction hood 10 is increased, the airflow is made more likely to leak out to outside of the suction hood 10, and collection efficiency of the airflow in exhaust direction is decreased.

If the lower end 10*d* of the opening edge of the air-collecting opening 10*a* of the suction hood 10, however, extends downward from the airflow control edge 14 by the specified size as described above, the outer circumferential portion of the ascending swirl airflow F2 in the exhaust direction can reliably be intercepted and separated into the air-collecting opening 10*a* of the suction hood 10 before the radially outward velocity component is increased, for example, as shown in FIG. 8, and the collection efficiency in the exhaust direction can be increased.

Figure 6:
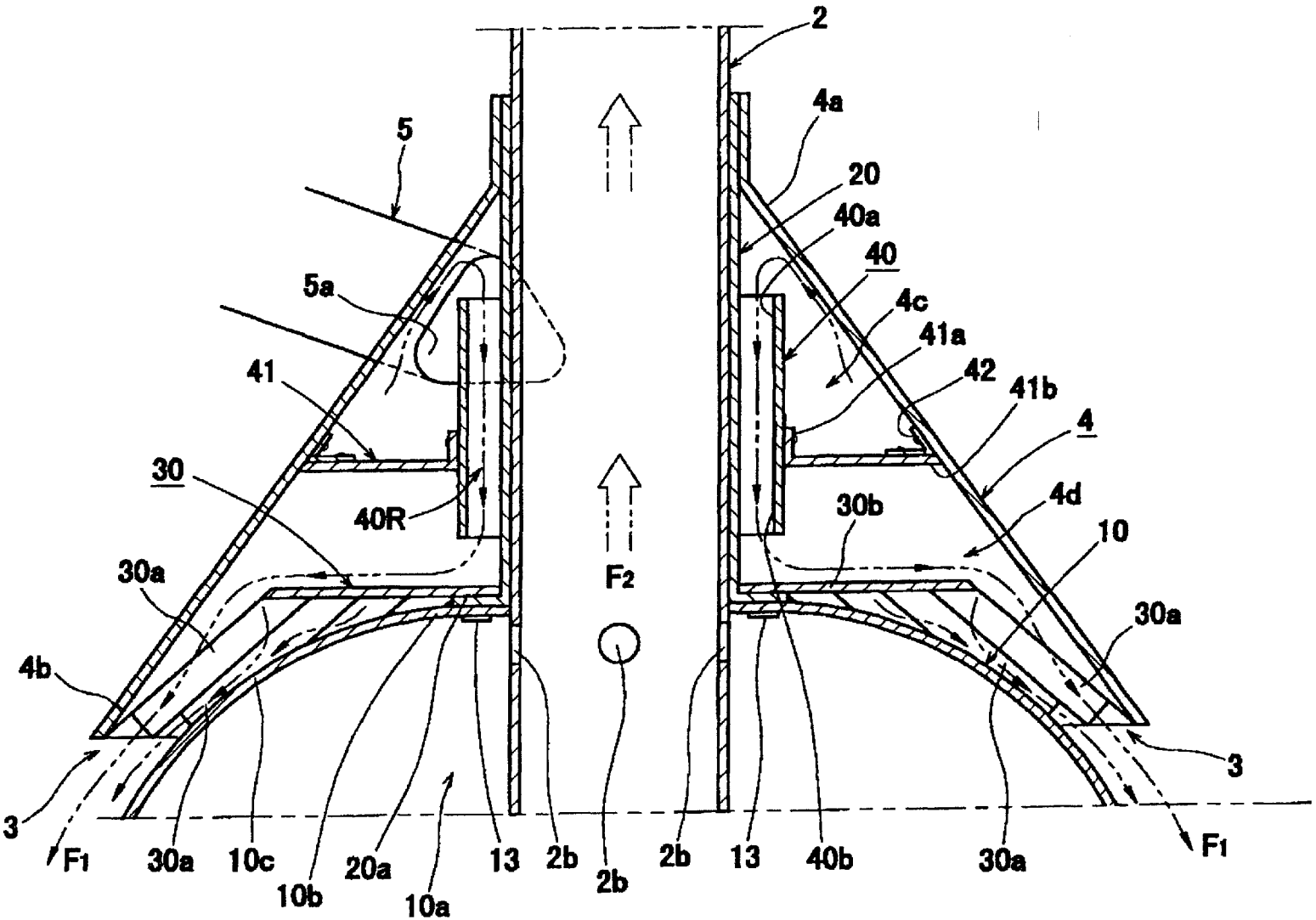
FIG. 6 is an enlarged sectional view showing functions of the air supply and exhaust apparatus.
Figure 7:
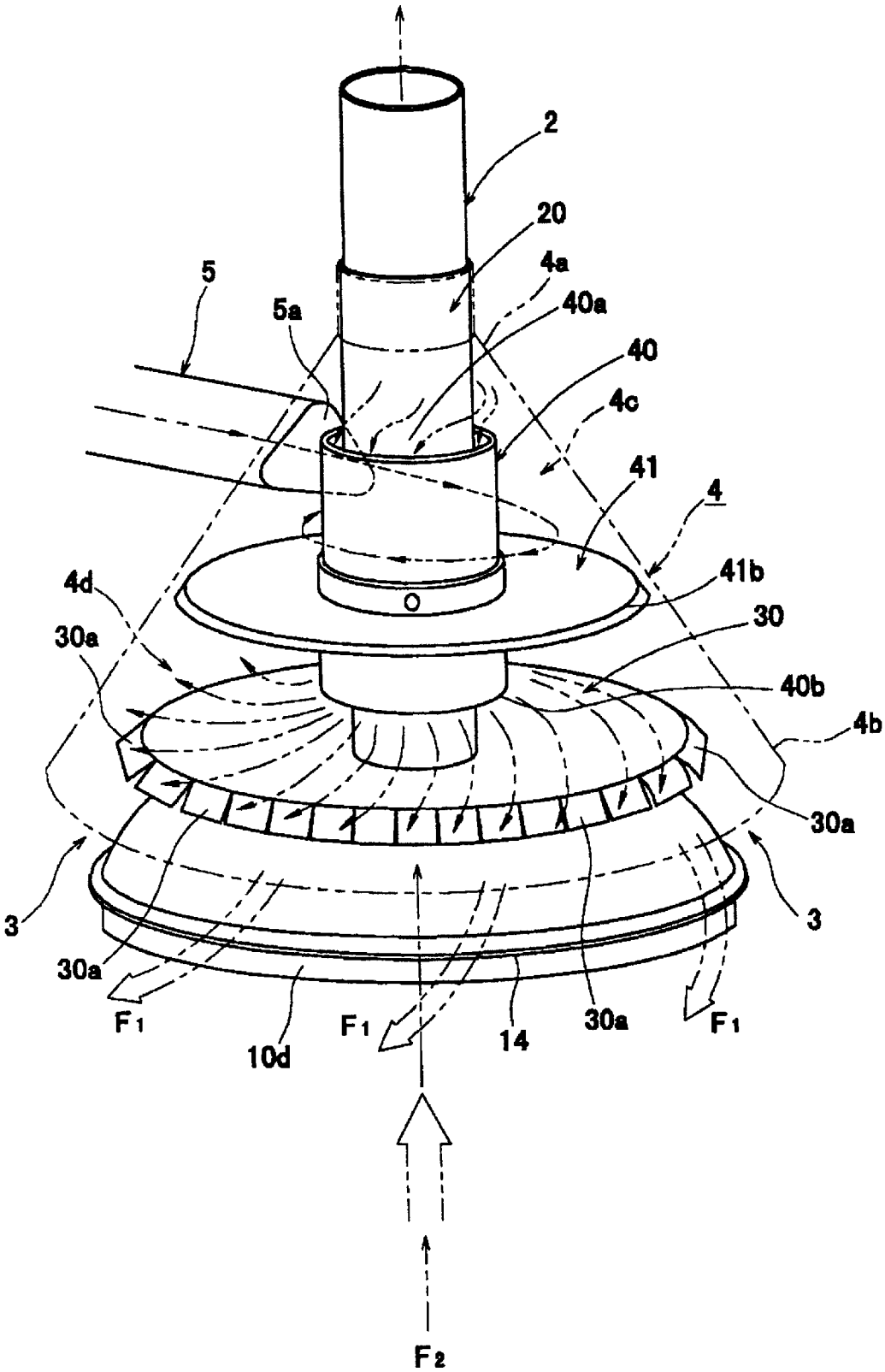
FIG. 7 is a perspective view showing functions of the air supply and exhaust apparatus.

When the fresh-air supply fan on the side of the fresh-air supply duct 5 and the suction fan on the side of the suction duct 2 in the above configuration are driven, for example, fresh air guided into the fresh-air introducing port 5*a* through the fresh-air supply duct 5 is initially blown out into the first supply air swirling space 4*c* in tangential directions by a blast pressure from the fresh-air supply fan, as shown in FIGS. 6 and 7. The air that has flowed into the first supply air swirling space 4*c* in swirling directions with a dynamic pressure on a given level is temporarily interrupted by the partition plate 41 and is uniformly dispersed in all over the first supply air space 4*c*.

After that, the air flows into the annular straightening passage 40R having a stable shape, the decreased passage diameter, and a specified vertical length, evenly from all the circumference of the upper end opening 40*a* of the passage 40R. Accordingly, the air is throttled when flowing through the annular straightening passage 40R in a specified period of time, and flow velocities of the air are further equalized.

The airflow having the flow velocities further equalized is then forwarded radially outward evenly from the lower end opening 40*b* while being swirled in the second supply air swirling space 4*d* that extends toward the air outlet 3 as described above, and is supplied to the air outlet 3 provided continuously in the circumferential direction between the inner circumferential surface of the fresh-air supply chamber 4 on the side of the lower end 4*b* and the outer circumferential surface of the shoulder 10*c* of the suction hood 10. When the airflow passes through the air outlet passage of the air outlet 3, the swirl flow generating stators 30*a*, 30*a*, . . . impart still larger vector in the swirling direction to the airflow, which turns into stronger and stable spiral swirl airflow F1 with equalized air velocities in all circumferential directions. The airflow F1 is blown out downward in oblique directions toward the outer circumference of heating and cooking equipment in the specified local region.

As a result, the blowoff swirl airflow F1 that is spiral and stable forms reliable air curtain flow that encircles smoke, smell, and the like from heating and cooking equipment in the specified local region so as to prevent diffusion thereof into the surroundings. Inside the airflow F1 and along a central axis thereof, on the other hand, stable swirl suction airflow F2 is formed that has a large suction force and that vertically ascends like a tornado by an action of a suction force the suction fan exerts, in a direction opposite to the airflow F1, i.e., toward the suction port 2*a* extending tubularly up to the vicinity of the surface of the air-collecting opening 10*a* of the suction hood 10 of the suction duct 2.

This arrangement makes possible reliable exhaust and cleaning of contaminated air such as smoke and smell in the vicinity of heating and cooking equipment encircled by the air curtain flow composed of the spiral blowoff swirl airflow F1.

Embodiment 2

Figure 9:
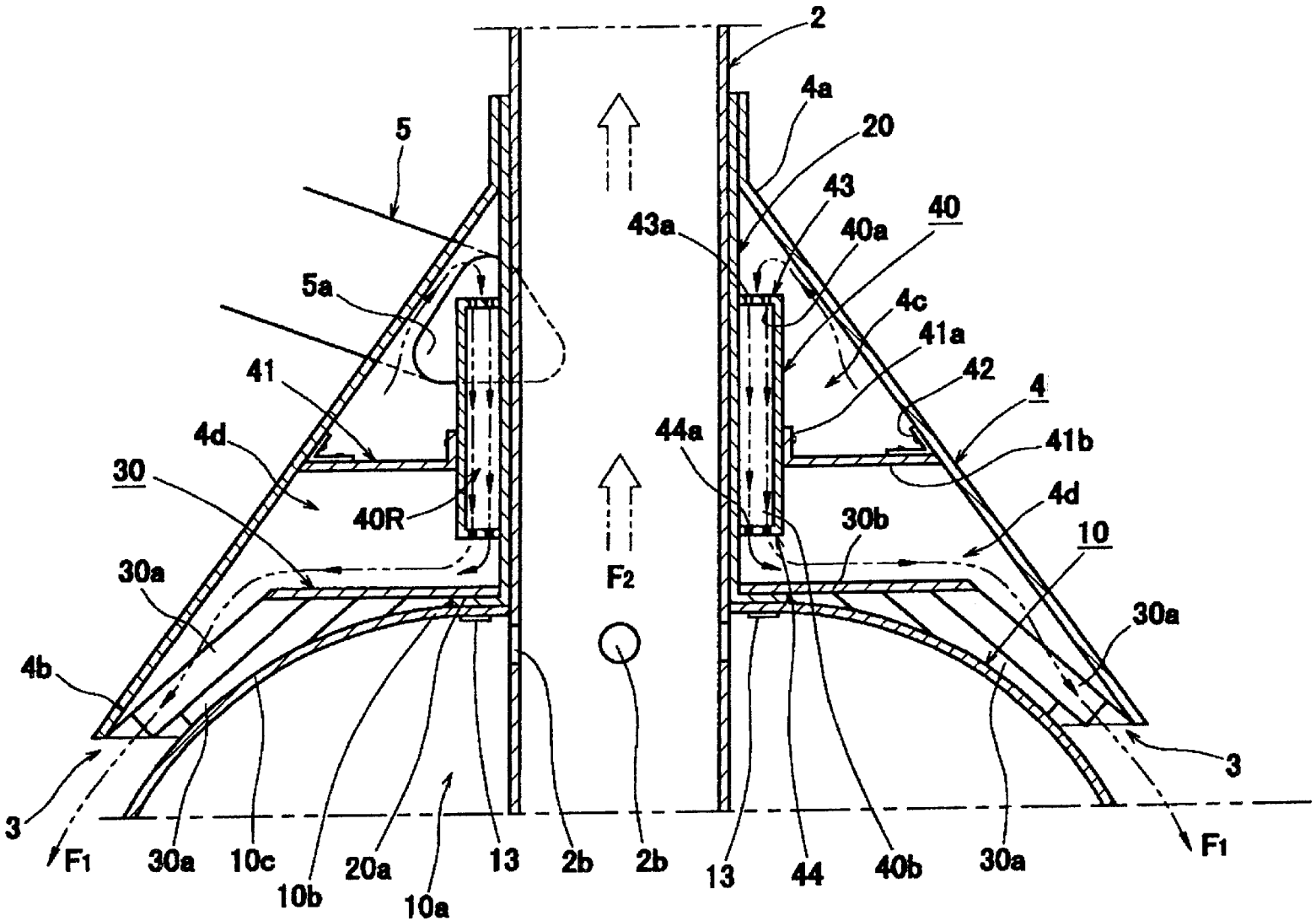
FIG. 9 is a sectional view showing a configuration of a tornado-type ventilator composed with employment of an air supply and exhaust apparatus in accordance with an embodiment 2 of the invention.
Figure 10:
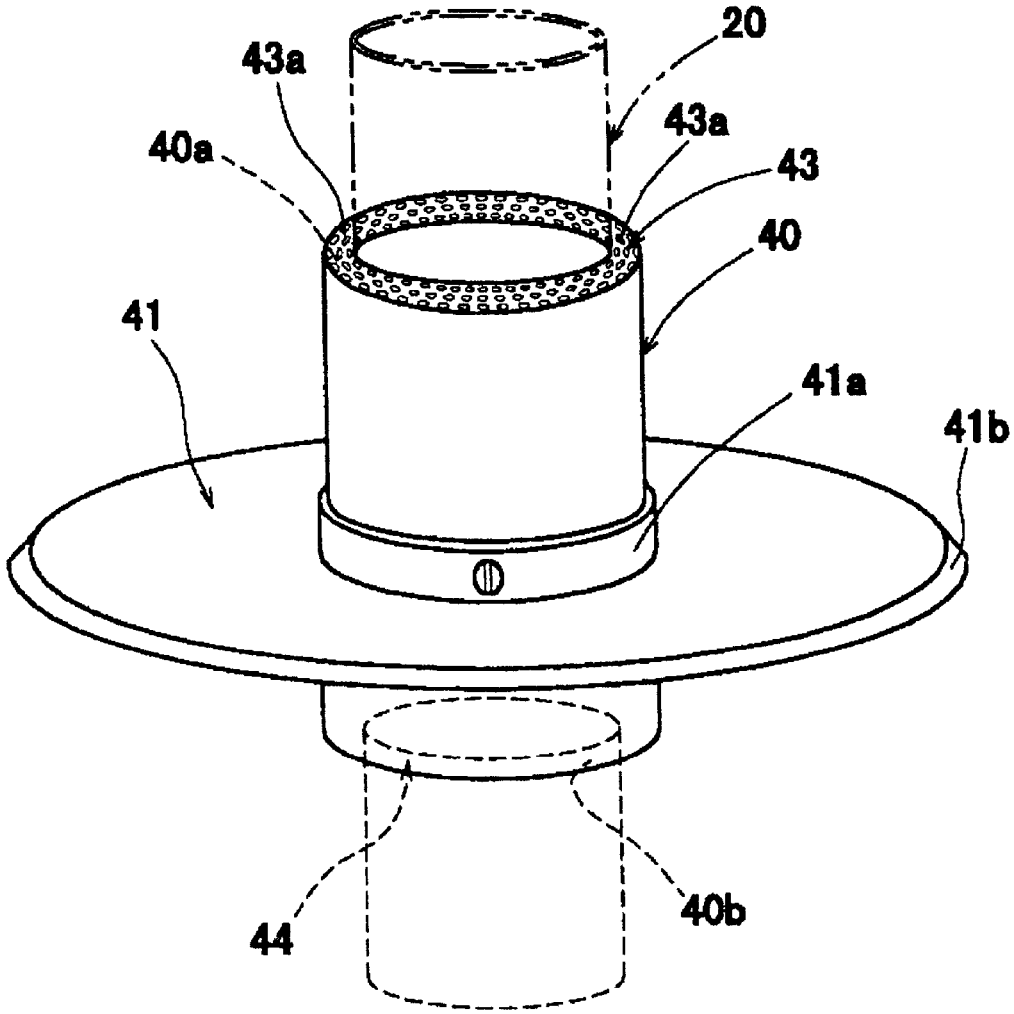
FIG. 10 is a perspective view showing a configuration of an important part of the air supply and exhaust apparatus.

FIGS. 9 and 10 show a configuration of a tornado-type local ventilator composed with employment of an air supply and exhaust apparatus in accordance with an embodiment 2 of the invention.

The embodiment is characterized in that, in the configuration of the tornado-type local ventilator of the embodiment 1, straightening effect is improved by provision of straightening plates 43 and 44 having a large number of straightening small holes 43*a*, 43*a*, . . . and 44*a*, 44*a*, . . . on the upper end opening (inflow port) 40*a* and the lower end opening (outflow port) 40*b*, respectively, of the straightening passage 40. For the straightening plates 43 and 44 is employed, for example, a structure like a punching plate.

With provision of the straightening plates 43 and 44 on the upper end opening (inflow port) 40*a* and the lower end opening (outflow port) 40*b* of the straightening passage 40R that achieves such a straightening effect as described above, swirl flow that still includes deviated flow in spite of the dynamic pressure diffusing effect by the partition plate 41 when flowing into the straightening passage 40R is initially straightened when passing through the large number of straightening small holes 43*a*, 43*a*, . . . , and flow velocity distribution of the swirl flow is thereby equalized.

Subsequently, the swirl flow having the flow velocity distribution equalized to a certain extent flows through the annular straightening passage 40R that has a stable shape and a small diameter while being throttled and swirling and while a specified span of time is elapsed, and flow velocity vector of the flow is thereby further equalized.

Then the swirl flow having the flow velocity vector stabilized after flowing through the annular straightening passage is further reliably straightened by the large number of straightening small holes 44*a*, 44*a*, . . . of the straightening plate 44 when the flow comes out of the lower end opening (outflow port) 40*b*. The swirl flow thereby obtains further equalized flow velocity distribution.

After that, the swirl flow having the flow velocity distribution equalized is made to flow out and spreads radially outward while swirling in the second supply air swirling space 4*d* that has increased passage diameters. The swirl flow having flowed out therefore spreads radially outward more uniformly with swirl components and is supplied more smoothly to the air outlet 3 having the swirl flow generating stators 30*a*, 30*a*, . . . , in comparison with the embodiment 1.

As a result, the spiral swirl vortex flow F1 that is blown out from the air outlet 3 has further equalized and stabilized flow velocity distribution, and stable air curtain flow that reliably encloses the local region is formed.

It is noted that an arrangement provided with only one of the straightening plates 43 and 44 is still effective as a matter of course and it is conceivable that the same straightening plates are provided in an intermediate part (middle) of the straightening passage 40R.

Embodiment 3

Figure 11:
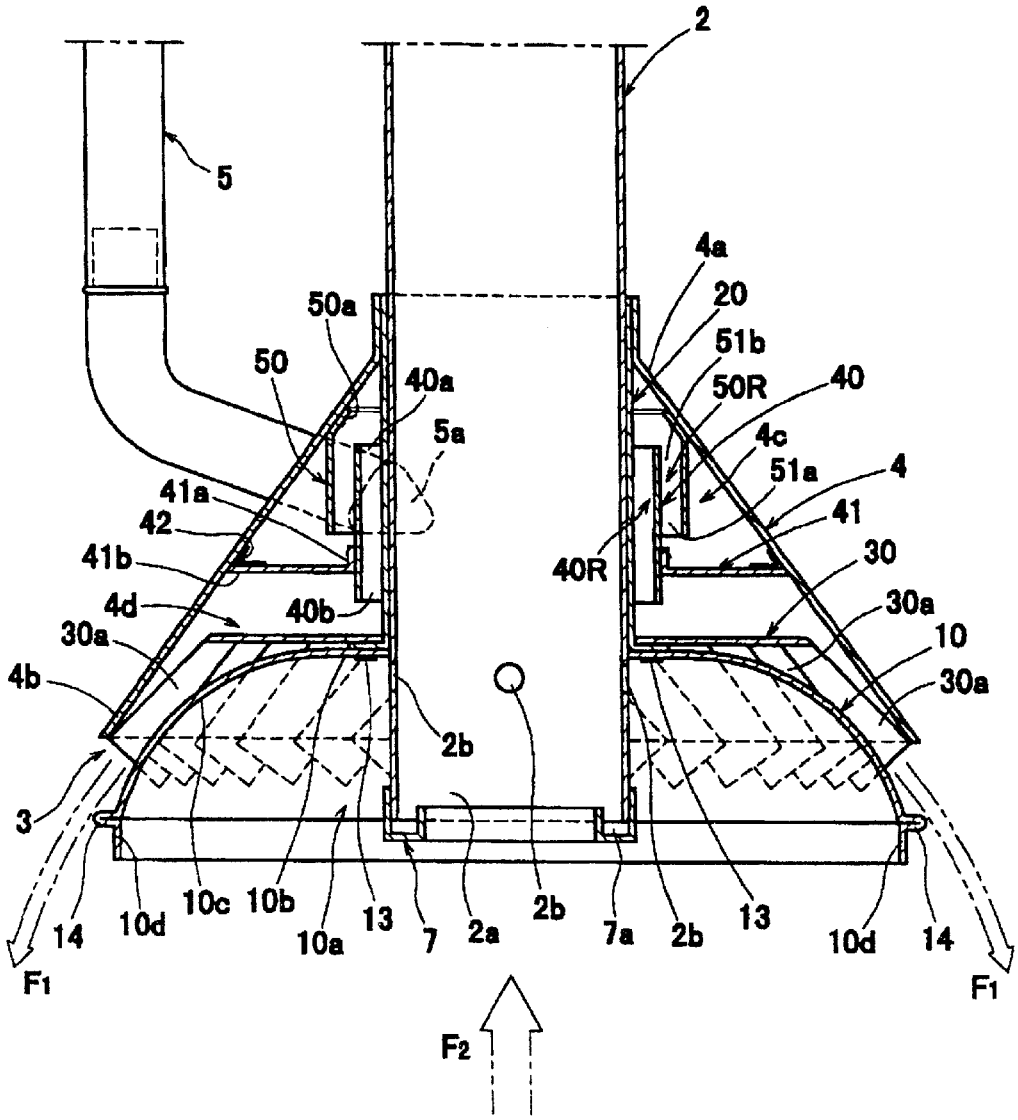
FIG. 11 is a sectional view showing a configuration of a tornado-type ventilator composed with employment of an air supply and exhaust apparatus in accordance with an embodiment 3 of the invention.
Figure 12:
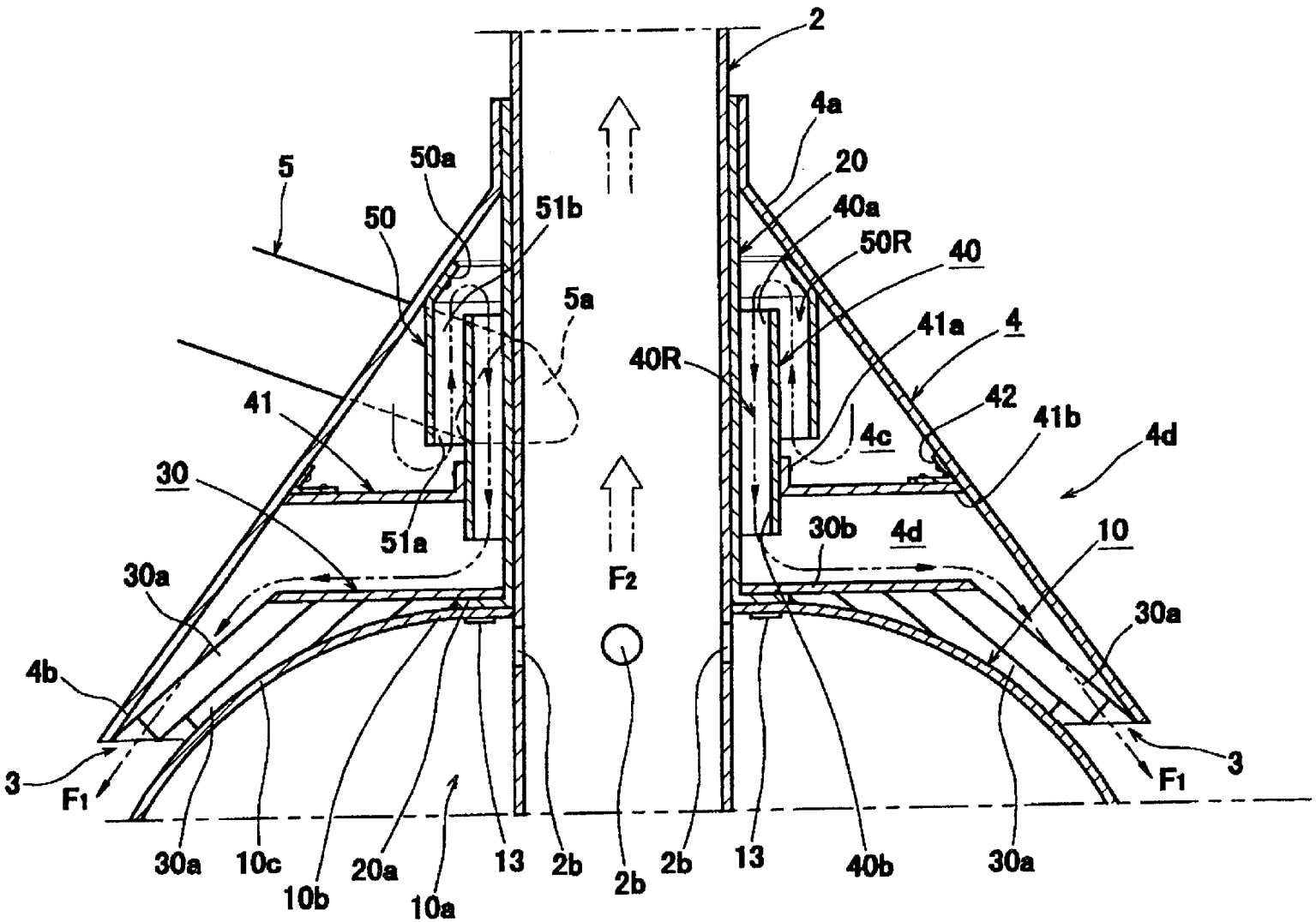
FIG. 12 is an enlarged sectional view showing functions of the air supply and exhaust apparatus.
Figure 13:
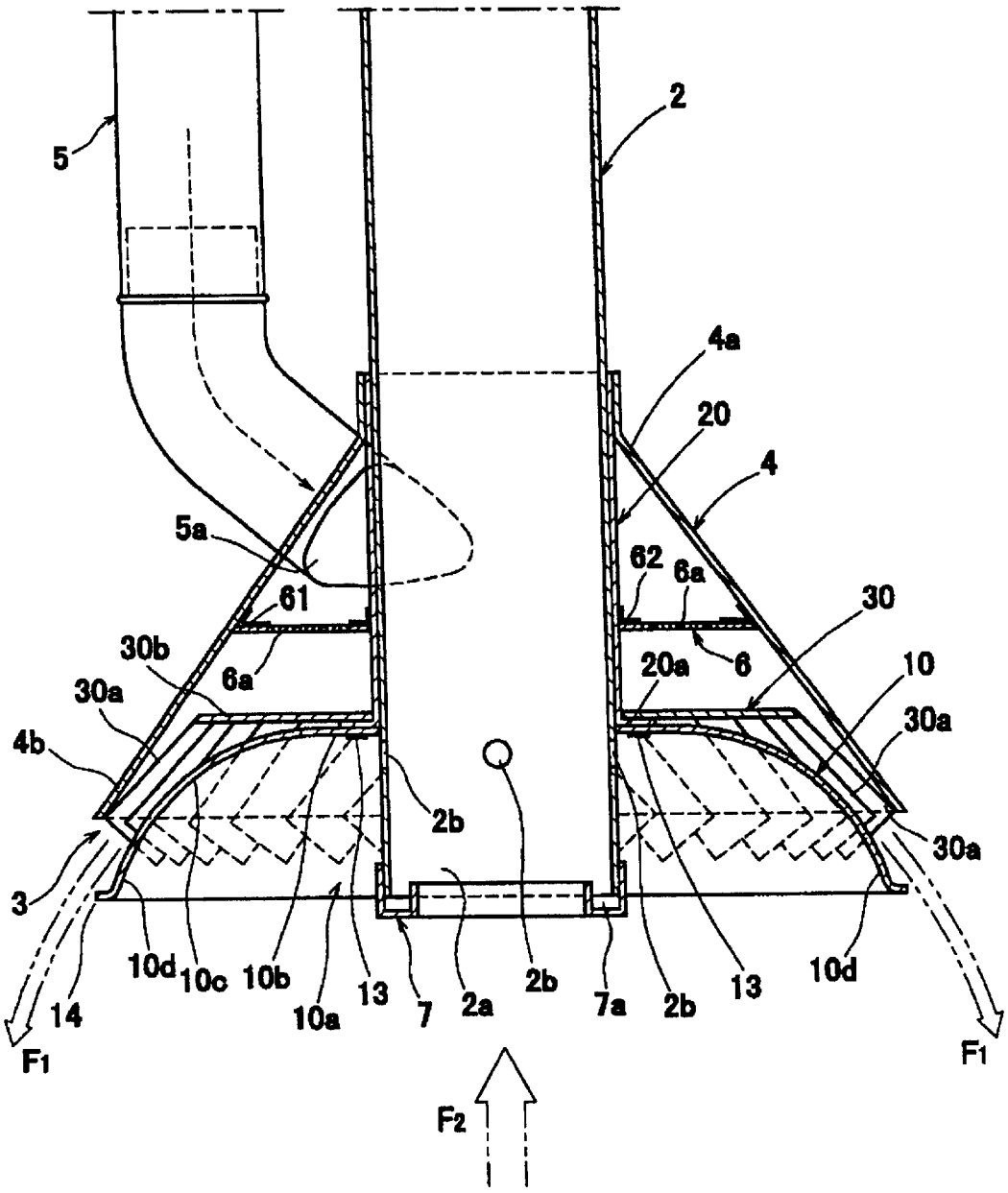
Fig. 13 Prior Art
FIG. 13 is a sectional view showing a configuration of a tornado-type local ventilator.

FIGS. 11 and 12 show a configuration of a tornado-type local ventilator composed with employment of an air supply and exhaust apparatus in accordance with an embodiment 3 of the invention.

The embodiment is characterized in that, in the configuration of the tornado-type local ventilator of the embodiment 1, straightening effect is improved by additional provision of a straightening passage 50R on an outer circumferential side of the straightening passage 40R, that is, by formation of two sets of straightening passages extending vertically, connected to each other through a winding, and radially parallel to each other.

In the configuration, a second cylinder wall 50 that has a large diameter and forms the second straightening passage 50R is provided a specified distance apart from an outer circumference of the first cylinder wall 40 that forms the straightening passage 40R of the embodiment 1 described above, and the outside second cylinder wall 50 is fixed to the top plate 4*a* of the fresh air supply chamber 4 so as to be positioned at a specified distance from the lower partition plate 41. With this arrangement, only a lower end of the passage 50R is opened, while an upper end of the passage 50R is closed with respect to the top plate 4*a*. The fixation to the top plate 4*a* is achieved by screws, with a tilt angle of an upper end circumference 50*a* of the second cylinder wall 50 fitted for a tilt angle of the inner circumferential wall surface of the top plate 4*a*.

In the above-mentioned upper first supply air swirling space 4*c* in the configuration are consequently formed continuous two sets of straightening passages, i.e., the second straightening passage 50R that is defined by the second cylinder wall 50 and that allows fresh air to flow from a lower opening 51*a* to an upper opening 51*b* while throttling passage diameter, and the first annular straightening passage 40R that is defined by the first cylinder wall 40 and that allows swirl flow straightened by the second straightening passage 50R and having stable flow velocity distribution to flow from the upper opening 40*a* to the lower opening 40*b* while throttling passage diameter.

The configuration therefore ensures more satisfactory effect of diffusing dynamic pressure, sufficiently longer time for straightening, more efficacious straightening effect, and further equalization of flow velocity distribution of blowoff airflow blown off from the air outlet 3, in comparison with those in the embodiment 1.

As a result, more reliable air curtain flow makes possible more efficient ventilation in a specified local region.

Other Embodiments

In any of the above embodiments is employed a so-called tornado-type structure for air supply and exhaust in which air is supplied in swirling directions in the first supply air swirling space 4*c* and is blown out while being spirally swirled by the swirl flow generating stators 30*a*, 30*a*, . . . provided in the air outlet 3.

The invention, however, is not limited to the tornado-type structure for air supply and exhaust. It is needless to say that the invention is effective for ordinary air supply and exhaust apparatus using non-tornado type air curtain flow.

What is claimed is:

1. An air supply and exhaust apparatus for blowing out air that has a specified blast pressure and that is introduced into an upper region in a specified supply air space from a supply air duct (5), as air curtain flow, to an outer circumference of a specified local region through a lower air outlet (3) that has a circumferential opening, while sucking air in the specified local region encircled by the air curtain flow, in a direction opposite to a direction in which the air is blown out, through a suction port (2*a*) located inside the air outlet (3) into an upper region of a suction duct (2) that is bored through a center part of the supply air space to extend outdoors, and exhausting the sucked air, characterized in that:

the supply air space is divided by a partition plate (41) into two upper and lower chambers, i.e., an upper first supply air space (4*c*) introducing air from the supply air duct (5) and a second supply air space (4*d*) extending toward the air outlet (3); and the first and second supply air spaces (4*c*, 4*d*) are communicated with each other through annular straightening passages (40R, 50R) of small passage diameters extending vertically on an outer circumference of the suction duct (2).

2. An air supply and exhaust apparatus as claimed in claim 1, characterized in that the straightening passage (40R) is defined by a cylinder wall (40) provided a specified distance apart from the suction duct (2).

3. An air supply and exhaust apparatus as claimed in claim 1, characterized in that the straightening passages (40R, 50R) are defined by a first cylinder wall (40) provided a specified distance apart from the suction duct (2) and having openings at both upper and lower ends thereof and by a second cylinder wall (50) provided a specified distance apart from the first cylinder wall (40) and having an opening only at a lower end thereof.

4. An air supply and exhaust apparatus as claimed in claim 1, characterized in that straightening plates (43, 44) having a large number of straightening holes (43*a*, 44*a*) are provided in the straightening passage (40R).

5. An air supply and exhaust apparatus as claimed in claim 1, characterized in that swirl flow generating stators (30*a*) for swirling spirally air that is blown out are provided in the air outlet (3).

6. An air supply and exhaust apparatus as claimed in claim 1, characterized in that the supply air duct (5) supplies air in swirling directions into the first supply air space (4*c*).

* * * * *